US009180500B2

(12) United States Patent
DeMint et al.

(10) Patent No.: US 9,180,500 B2
(45) Date of Patent: Nov. 10, 2015

(54) HOT ROLLING OF THICK URANIUM MOLYBDENUM ALLOYS

(71) Applicant: Babcock & Wilcox Technical Services Y-12, LLC, Oak Ridge, TN (US)

(72) Inventors: Amy L. DeMint, Kingston, TN (US); Jack G. Gooch, Seymour, TN (US)

(73) Assignee: Consolidated Nuclear Security, LLC, Reston, VA (US)

( * ) Notice: Subject to any disclaimer, the term of this patent is extended or adjusted under 35 U.S.C. 154(b) by 440 days.

(21) Appl. No.: 13/626,246

(22) Filed: Sep. 25, 2012

(65) Prior Publication Data

US 2014/0083570 A1 Mar. 27, 2014

(51) Int. Cl.

| | |
|---|---|
| ***C22C 43/00*** | (2006.01) |
| ***B21B 3/00*** | (2006.01) |
| ***C22F 1/18*** | (2006.01) |

(52) U.S. Cl.

CPC ... *B21B 3/00* (2013.01); *C22F 1/18* (2013.01); *B21B 2265/14* (2013.01); *B21B 2265/22* (2013.01)

(58) Field of Classification Search

CPC ..... C22F 1/18; B21B 3/00

See application file for complete search history.

(56) References Cited

U.S. PATENT DOCUMENTS

| | | | | |
|---|---|---|---|---|
| 2,877,149 | A | 5/1946 | Kaufmann | |
| 4,705,577 | A | 11/1987 | Ondracek | |
| 7,100,670 | B1 | 9/2006 | Hofman et al. | |
| 8,163,112 | B2 | 4/2012 | Gooch et al. | |
| 2010/0282375 | A1 * | 11/2010 | Gooch et al. | 148/557 |

OTHER PUBLICATIONS

Smith, William F.; Foundations of Materials Science and Engineering; Second Edition; 1993; pp. 184-185.

* cited by examiner

*Primary Examiner* — Veronica F Faison

(74) *Attorney, Agent, or Firm* — Michael J. Renner, Esq.; Luedeka Neely Group, P.C.

(57) ABSTRACT

Disclosed herein are processes for hot rolling billets of uranium that have been alloyed with about ten weight percent molybdenum to produce cold-rollable sheets that are about one hundred mils thick. In certain embodiments, the billets have a thickness of about ⅞ inch or greater. Disclosed processes typically involve a rolling schedule that includes a light rolling pass and at least one medium rolling pass. Processes may also include reheating the rolling stock and using one or more heavy rolling passes, and may include an annealing step.

17 Claims, 1 Drawing Sheet

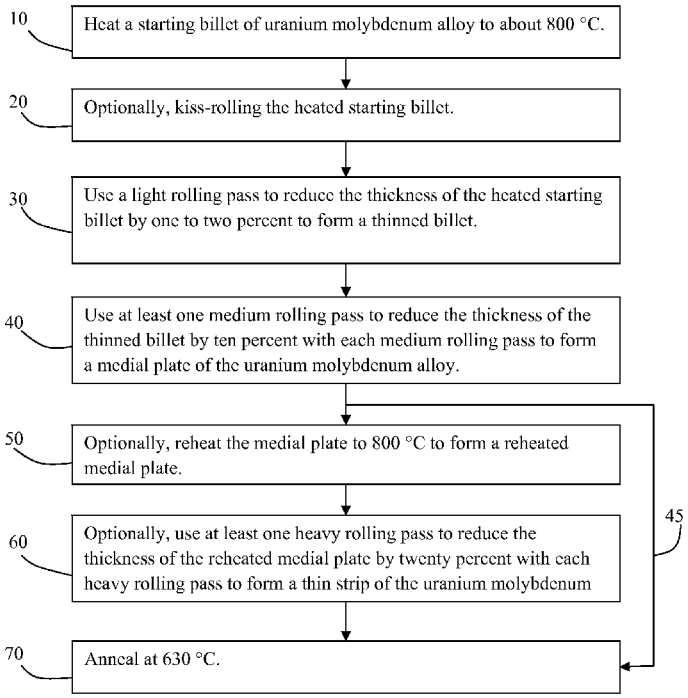

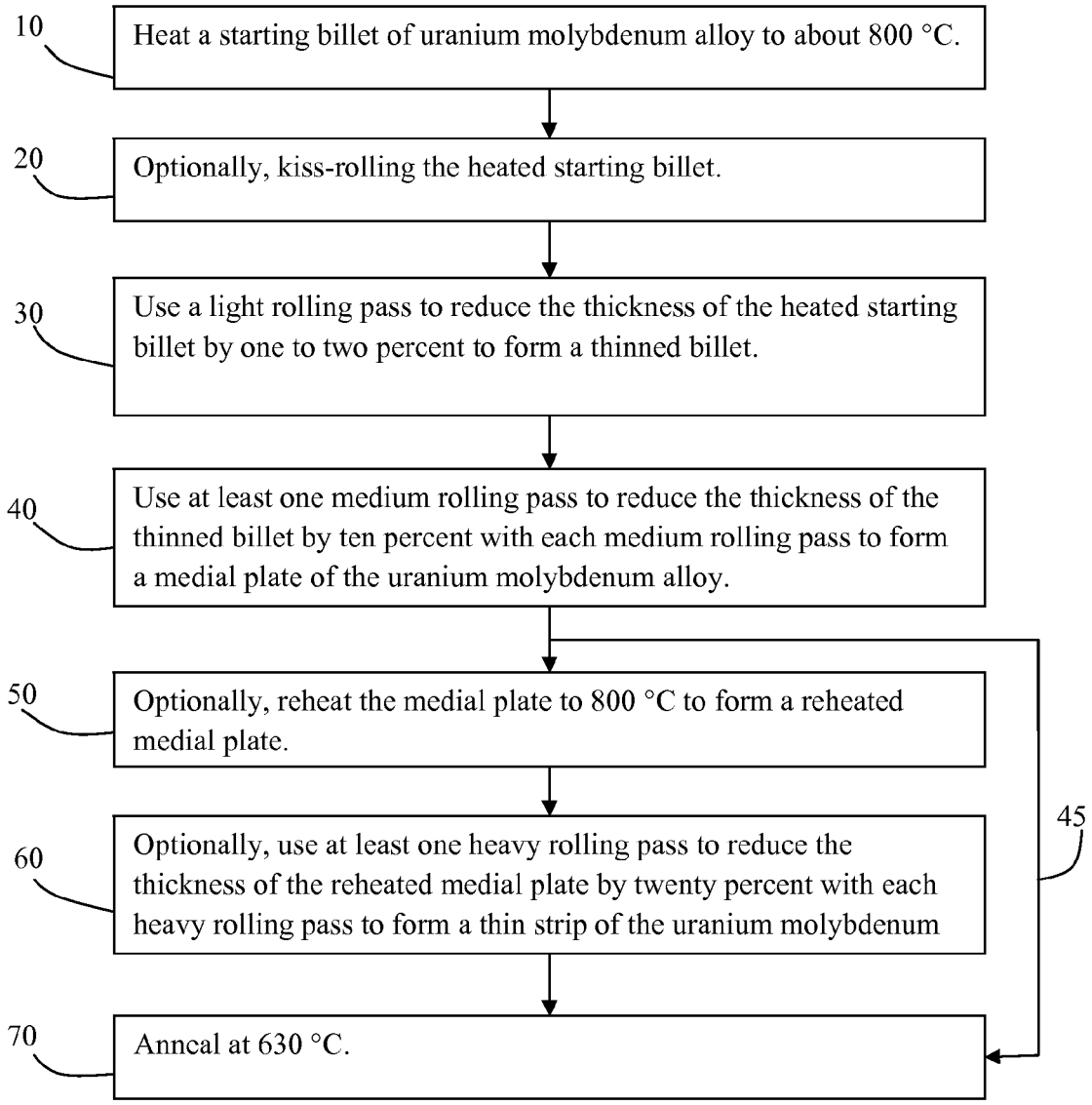
10
Heat a starting billet of uranium molybdenum alloy to about 800 °C.
20
Optionally, kiss-rolling the heated starting billet.
30
Use a light rolling pass to reduce the thickness of the heated starting billet by one to two percent to form a thinned billet.
40
Use at least one medium rolling pass to reduce the thickness of the thinned billet by ten percent with each medium rolling pass to form a medial plate of the uranium molybdenum alloy.
50
Optionally, reheat the medial plate to 800 °C to form a reheated medial plate.
60
Optionally, use at least one heavy rolling pass to reduce the thickness of the reheated medial plate by twenty percent with each heavy rolling pass to form a thin strip of the uranium molybdenum
45
70
Anneal at 630 °C.

HOT ROLLING OF THICK URANIUM MOLYBDENUM ALLOYS

GOVERNMENT RIGHTS

The U.S. Government has rights to this invention pursuant to contract number DE-AC05-00OR22800 between the U.S. Department of Energy and Babcock & Wilcox Technical Services Y-12, LLC.

FIELD

This disclosure relates to the field of metal working. More particularly, this disclosure relates to hot rolling of uranium molybdenum alloys.

BACKGROUND

Uranium that may be isotopically enriched in $^{235}U$ may be alloyed with molybdenum for use as a reactor fuel. One desired configuration of such an alloy is a 10-15 mil (0.010-0.015 inch) foil strip of uranium that is alloyed with about ten weight percent molybdenum. Such material may be fabricated by cold rolling a sheet of the alloy that is about one hundred mils (about one-tenth inch) thick to the desired final thickness (10-15 mils). However, it is difficult to produce sheet stock that is one hundred mils thick in quantities that are sufficient for practical use. A principal reason for this difficulty is the result of a fundamental difference between the effectiveness of typical hot rolling processes that may be used on unalloyed uranium and the results of those same hot rolling processes when they are used on uranium that is alloyed with molybdenum. Unalloyed uranium foils may fabricated by casting a thick billet (⅞ inch or thicker) and then using standard hot rolling processes to reduce the thickness of the thick billet to the desired thickness (e.g., about one hundred mils thick). However, when those same standard hot rolling processes are used on comparable thick cast billets (⅞ inch or thicker) of uranium alloyed with ten weight percent molybdenum, the billets typically fail (break) during the hot rolling process. This renders thick cast billets of uranium/molybdenum generally unusable for foil production. To overcome this problem, various alternate production techniques have been suggested or employed. For example, in one alternate process, a thick (e.g., ⅞ inch or thicker) billet of uranium alloyed with molybdenum is cast, and then it is milled (machined) to one-tenth inch thickness for the subsequent cold rolling process. However, this first alternate method produces an unacceptable amount of scrap. In a second alternate method, a thin (e.g., ⅜ inch thick) billet of uranium alloyed with molybdenum is cast and then it is hot rolled using the same rolling schedule (reduction steps and temperatures) that is applicable for unalloyed uranium. While such thin billets typically do not break during these hot rolling processes, very large quantities of these thin castings would be required to produce the amount of foil needed for commercial applications. What are needed therefore are more reliable and practical methods for using thick castings (⅞ inch or thicker) of uranium that is alloyed with about ten weight percent molybdenum as the starting material for preparing stock material that is suitable (i.e., that is about one hundred mils thick) for cold rolling into foil.

SUMMARY

The present disclosure provides methods for forming a cold-rollable sheet of a uranium molybdenum alloy. Many embodiments begin with heating to between about 790° C. to about 860° C. a starting billet of the uranium molybdenum alloy to form a heated starting billet. In certain embodiments, the starting billet has a thickness of ⅞ inch or greater. Some embodiments involve a step of kiss-rolling the heated starting billet. The heated starting billet may then be reduced in thickness to form a thinned billet by using at least one light rolling pass, such that the thickness of the heated starting billet is reduced by about one to two percent with each light rolling pass. The thickness of the thinned billet may then be reduced using at least one medium rolling pass where the thickness of the thinned billet is reduced between about eight percent to about twelve percent with each medium rolling pass. In some embodiments the medium pass(es) produces (produce) a medial plate of the uranium molybdenum alloy that is suitable for use as the cold-rollable sheet of the uranium molybdenum alloy.

Some embodiments involve reheating the medial plate to between about 790° C. to about 860° C. to form a reheated medial plate and then reducing the thickness of the reheated medial plate using at least one heavy rolling pass to reduce the thickness of the reheated medial plate between about fifteen percent to about twenty-five percent with each heavy rolling pass. The result of these embodiments is a thin strip of the uranium molybdenum alloy that is suitable for use as the cold-rollable sheet of the uranium molybdenum alloy.

According to some embodiments, the thin strip of the uranium molybdenum alloy or the medial plate of the uranium molybdenum alloy is annealed between about 620° C. and about 640° C.

BRIEF DESCRIPTION OF THE DRAWINGS

Various advantages are apparent by reference to the detailed description in conjunction with the FIGURE which depicts various steps of several embodiments of methods for hot rolling thick uranium molybdenum alloys.

DETAILED DESCRIPTION

In the following detailed description of the preferred and other embodiments, reference is made to the accompanying FIGURE, which forms a part hereof, and within which is shown by way of illustration the practice of specific embodiments of methods for hot rolling thick uranium molybdenum alloys. It is to be understood that other embodiments may be utilized, and that structural changes may be made and processes may vary in other embodiments.

Disclosed herein are various embodiments of methods for hot rolling thick uranium molybdenum alloys to form a sheet of a uranium molybdenum alloy that is cold-rollable. The methods depicted are particularly suitable for alloys that contain 10% weight molybdenum with the balance of the alloy being uranium that may be isotopically enriched in $^{235}U$. It is to be noted that the amount of $^{235}U$ content as a percentage of other uranium isotopes in the alloy is not critical to the operation of the processes disclosed herein. In some embodiments the weight percent of molybdenum may be a value in a range between about 9% and 11%. As used herein the term "uranium molybdenum alloy" encompasses any alloy that includes additional "trace" constituents, provided that the weight percent of the combined "trace" constituents is less than 0.5%, and provided that the weight percent of molybdenum has a value in a range between 9% and 11% of the total alloy weight, and provided that the balance of the alloy is uranium.

As illustrated in the Figure, a typical embodiment starts with a step 10 in which a starting billet of uranium molybdenum alloy is heated to between about 790° C. to about 860° C., and preferably at about 800° C. The starting billet typically has a thickness of ⅜ inch or greater. In preferred embodiments, the starting billet has a thickness of ⅞ inch or greater. In embodiments having larger thicknesses, the thicker starting billets will typically be accommodated with longer preheat times. In some embodiments, as illustrated in step 20, after the starting billet is heated it is "kiss-rolled." This means that the billet is subjected to a rolling pass to smooth the surfaces and provide a uniform thickness, but not provide any significant reduction in the average billet thickness. Then in a typical embodiment, at least one light rolling pass is used to reduce the thickness of the heated starting billet by one to two percent with each light rolling pass to form a thinned billet. This is illustrated as step 30 in the Figure. Step 30 is typically followed by step 40, which involves at least one medium rolling pass. Each medium rolling pass reduces the thickness of the thinned billet between about eight percent to about twelve percent, and preferably at about ten percent. The output of step 40 is a "medial plate" of the uranium molybdenum alloy. In some embodiments, particularly where the starting billet is comparatively thin, the medial plate produced from step 40 has a thickness (i.e., a thickness of about one hundred mils) that is "cold-rollable" (i.e., that is suitable for cold rolling). In such embodiments, the medial plate of the uranium molybdenum alloy is the cold-rollable sheet of the uranium molybdenum alloy that is desired from the disclosed forming process. However, it is important to note that prior to actual cold rolling, the cold-rollable sheet of the uranium molybdenum alloy (i.e., the medial plate in such embodiments) is typically routed (as illustrated by bypass arrow 45) to a post-process step 70 of annealing between about 620° C. to about 640° C., and preferably at about 630° C. The post-process annealing step 70 may be performed immediately after the medial plate is formed per step 40. In preferred embodiments, annealing of the medial plate from step 40 is delayed no longer than 24 hours to relieve stresses.

In many embodiments, further process of the medial plate is desired before annealing, as illustrated by steps 50 and 60 in the FIGURE. In step 50 the medial plate from step 40 is reheated to between about 790° C. to about 860° C., and preferably at about 800° C. Then at least one heavy rolling pass is used, where each heavy rolling pass reduces the thickness of the reheated medial plate by about fifteen percent to about twenty-five percent, and preferably about twenty percent. The output of step 60 is a thin strip of the uranium molybdenum alloy. When steps 50 and 60 are employed, the thin strip of the uranium molybdenum alloy (from step 60) is the cold-rollable sheet of the uranium molybdenum alloy that is desired from the disclosed forming process. As with embodiments utilizing bypass arrow 45, prior to actual cold rolling, the cold-rollable sheet of the uranium molybdenum alloy is generally subjected to a post-process step 70 of annealing between about 620° C. to about 640° C., and preferably at about 630° C. Again, post-process step 70 may be performed immediately after the thin strip of the uranium molybdenum alloy is formed per step 60, or the post-process step 70 is preferably delayed no longer than 24 hours.

In summary, embodiments disclosed herein provide a method for forming a cold-rollable sheet of a uranium molybdenum alloy. The foregoing descriptions of embodiments have been presented for purposes of illustration and exposition. They are not intended to be exhaustive or to limit the embodiments to the precise forms disclosed. Obvious modifications or variations are possible in light of the above teachings. The embodiments are chosen and described in an effort to provide the best illustrations of principles and practical applications, and to thereby enable one of ordinary skill in the art to utilize the various embodiments as described and with various modifications as are suited to the particular use contemplated. All such modifications and variations are within the scope of the appended claims when interpreted in accordance with the breadth to which they are fairly, legally, and equitably entitled.

What is claimed is:

1. A method for forming a cold-rollable sheet of a uranium molybdenum alloy comprising:

(a) heating between about 790° C. to about 860° C. a starting billet of the uranium molybdenum alloy to form a heated starting billet;

(b) reducing the thickness of the heated starting billet using at least one light rolling pass wherein the thickness of the heated starting billet is reduced by about one to two percent with each light rolling pass to form a thinned billet; and (c) reducing the thickness of the thinned billet to form a medial plate of the uranium molybdenum alloy using at least one medium rolling pass to reduce the thickness of the thinned billet between about eight percent to about twelve percent with each medium rolling pass;

wherein the medial plate of the uranium molybdenum alloy is the cold-rollable sheet of the uranium molybdenum alloy.

2. The method of claim 1 wherein the starting billet is heated to about 800° C.

3. The method of claim 1 wherein the thickness of the thinned billet is reduced by about ten percent with each medium rolling pass.

4. The method of claim 1 further comprising:

(d) reheating the medial plate to form a reheated medial plate; and (e) forming a thin strip of the uranium molybdenum alloy using at least one heavy rolling pass to reduce the thickness of the reheated medial plate between about fifteen percent to about twenty-five percent with each heavy rolling pass;

wherein the thin strip of the uranium molybdenum alloy is the cold-rollable sheet of the uranium molybdenum alloy.

5. The method of claim 4 wherein the thickness of the reheated medial plate is reduced by about twenty percent with each heavy rolling pass.

6. The method of claim 4 further comprising annealing the thin strip of the uranium molybdenum alloy.

7. The method of claim 6 wherein the medial plate is annealed between about 620° C. to about 640° C.

8. The method of claim 1 further comprising annealing the medial plate of the uranium molybdenum alloy.

9. The method of claim 8 wherein the medial plate is annealed between about 620° C. to about 640° C.

10. A method for forming a cold-rollable sheet of a uranium molybdenum alloy comprising:

(a) heating between about 790° C. to about 860° C. a starting billet of the uranium molybdenum alloy to form a heated starting billet, the starting billet having a thickness of about ⅞ inch or greater;

(b) reducing the thickness of the heated starting billet using at least one light rolling pass wherein the thickness of the heated starting billet is reduced by about one to two percent with each light rolling pass to form a thinned billet; and (c) reducing the thickness of the thinned billet to form a medial plate of the uranium molybdenum alloy using at least one medium rolling pass to reduce the thickness of the thinned billet between about eight percent to about twelve percent with each medium rolling pass;

wherein the medial plate of the uranium molybdenum alloy is the cold-rollable sheet of the uranium molybdenum alloy.

11. The method of claim 10 further comprising annealing the medial plate of the uranium molybdenum alloy.

12. The method of claim 11 wherein the medial plate is annealed between about 620° C. to about 640° C.

13. The method of claim 10 further comprising:

(d) reheating the medial plate to form a reheated medial plate; and (e) forming a thin strip of the uranium molybdenum alloy using at least one heavy rolling pass to reduce the thickness of the reheated medial plate between about fifteen percent to about twenty-five percent with each heavy rolling pass;

wherein the thin strip of the uranium molybdenum alloy is the cold-rollable sheet of the uranium molybdenum alloy.

14. The method of claim 13 wherein the thickness of the reheated medial plate is reduced by about twenty percent with each heavy rolling pass.

15. The method of claim 13 further comprising annealing the thin strip of the uranium molybdenum alloy.

16. The method of claim 15 wherein the medial plate is annealed between about 620° C. to about 640° C.

17. A method for forming a cold-rollable sheet of a uranium molybdenum alloy comprising:

(a) heating between about 790° C. to about 860° C. a starting billet of the uranium molybdenum alloy to form a heated starting billet;

(b) kiss-rolling the heated starting billet;

(c) reducing the thickness of the heated starting billet using at least one light rolling pass wherein the thickness of the heated starting billet is reduced by about one to two percent with each light rolling pass to form a thinned billet; and (d) reducing the thickness of the thinned billet to form a medial plate of the uranium molybdenum alloy using at least one medium rolling pass to reduce the thickness of the thinned billet between about eight percent to about twelve percent with each medium rolling pass;

wherein the medial plate of the uranium molybdenum alloy is the cold-rollable sheet of the uranium molybdenum alloy.

* * * * *